United States Patent [19]

Schuurmans et al.

[11] Patent Number: 4,744,120

[45] Date of Patent: May 17, 1988

[54] SHOE SUPPORT FOR SHOE UPPER CONFORMING MACHINE

[75] Inventors: Marinus E. Schuurmans, Waalwijk, Netherlands; Frank Bramley, Glenfield; Kingsley J. Tutt, Birstall, both of United Kingdom

[73] Assignee: British United Shoe Machinery Limited, Leicester, England

[21] Appl. No.: 22,853

[22] Filed: Mar. 6, 1987

[30] Foreign Application Priority Data

Mar. 8, 1986 [GB] United Kingdom ..... 8605766

[51] Int. Cl.[4] ..... A43D 21/12; A43D 21/16

[52] U.S. Cl. ..... 12/105; 12/10; 12/10.1

[58] Field of Search ..... 12/7, 8.8, 10, 10.1, 12/10.5, 10.8, 11.3, 11.5, 12, 12.3, 12.5, 14.2, 14.4

[56] References Cited

U.S. PATENT DOCUMENTS

| | | | |
|---|---|---|---|
| 3,138,810 | 6/1964 | Becker | 12/12.3 |
| 3,386,115 | 6/1968 | McKibbin et al. | 12/12.5 |
| 3,631,554 | 1/1972 | Hartshorn et al. | 12/10.5 |
| 3,918,115 | 11/1975 | Santilli | 12/14.2 |
| 4,654,914 | 4/1987 | Leeder | 12/10.5 |
| 4,679,269 | 7/1987 | Becka et al. | 12/10.5 |

*Primary Examiner*—Steven N. Meyers

*Attorney, Agent, or Firm*—Owen J. Meegan; Aubrey C. Brine

[57] ABSTRACT

A combined heel end assembling, backpart moulding and heel seat lasting machine comprises a shoe support for supporting a shoe bottom uppermost. For gripping and tensioning the shoe upper on its last prior to the combined operation taking place, two grippers are provided with each of which is associated a reaction lever/presser member, the latter serving to hold the last in position while the grippers tension the upper heightwise. Thereafter, the grippers are moved lengthwise of the shoe to tension the upper about the heel end of the last. The machine also comprises a heel band for backpart moulding and wipers for lasting the heel seat region of the shoe, adhesive applying means being provided for applying adhesive in the heel seat prior to lasting. A plurality of positional adjustments within the shoe support is provided.

26 Claims, 5 Drawing Sheets

12

162
14
16
18
20
28
78
62
88
10
24
22

SHOE SUPPORT FOR SHOE UPPER CONFORMING MACHINE

BACKGROUND OF THE INVENTION

This invention is concerned with a shoe support for supporting a shoe, comprising an upper on a last, for a shoe upper conforming operation to be performed thereon, and with shoe upper conforming machines of which such a shoe support forms part.

There is described in U.S. patent application Ser. No. 3,138,810 a heel end assembling and backpart moulding machine having a central heat-activating station and two assembling and backpart moulding stations arranged for operating upon respectively left and right shoes. At each station is provided a shoe support for supporting a shoe bottom-up and including a heel support in the form of a heel pin and a toe rest, a holddown against which a shoe placed upon the shoe support is urged upwardly to a heightwise position in which the heel seat region of the shoe bottom is correctly oriented in relation to the plane of wiper means by which upstanding lasting marginal portions of the shoe upper, at the heel end thereof, can be wiped over and pressed against corresponding marginal portions of an insole, and a heel band by which the backpart of the shoe upper can be moulded to conform to the shape of the last, the heel band and wiper means both being mounted in a wiper head which is movable fore-and-aft of the machine between an advanced, operative, position and a retracted, out-of-the-way position. In using this machine, the operator places a last on the heel pin and positions a shoe upper thereon in the correct heightwise orientation. At this stage an insole may already have been attached, by conventional means, to the shoe bottom, or alternatively a loose insole may also be located correctly on the shoe bottom by the operator. The operator then ensures that the upper is properly tensioned lengthwise and heightwise of the last and initiates a cycle of operation of the machine in which firstly the shoe is correctly positioned heightwise by being jacked up against the holddown, and thereafter the wiper head is advanced to its operative position, determined by engagement of the heel band with the backpart of the shoe, whereupon a backpart moulding operation is effected, together with an inflanging operation on the upstanding lasting margin of the upper. The heat-activating station is used for pre-heating for activation the backpart of shoes in which especially thermoplastic heel end stiffeners have been inserted, the arrangement being such that, in the backpart moulding operation, the activated stiffener takes the form of the heel end portion of the last, and, following cooling, consolidates and thus serves to retain the conformed shape.

It will be appreciated that, especially with loose insoles, but in any event, it is difficult for the operator to handle the various components of the shoe while at the same time ensuring that they are retained in their correct locations in relation to the last. In a development of the aforementioned machine, therefore, which development has been commercially available for a number of years, shoe holding means in the form of grippers has been provided at each assembling and backpart moulding station for gripping the shoe upper, in the forepart region thereof, and applying a tensioning force lengthwise of the shoe and also heightwise thereof. To this end, the grippers are caused to effect a composite motion about a pivotal axis under the control of powered means.

It will of course be appreciated that the holddown of the machine serves to clamp the shoe on its heel pin in the heel seat region thereof while the grippers are operated in the region of the forepart. In some instances, this has lead to the shoe being caused to tilt on the shoe support in such a manner that the heel seat region is no longer correctly oriented in the wiping plane with the consequence that the backpart of the shoe is incorrectly positioned in relation to the heel band. Furthermore, the presence of the holddown in contact with the shoe bottom at this stage makes access to the backseam region of the shoe more difficult so that the operator has to exercise a good deal of manual dexterity in order to ensure the correct positioning of the upper on the last prior to the assembling, backpart moulding and heel seat lasting operation. In addition, the commercially available machine referred to above also is capable of performing a heel seat lasting operation, using the same wiper means, and to this end is also provided with adhesive applying means which however relies upon the backpart of the shoe being correctly oriented for the application of adhesive in the correct pattern and at the correct location in the heel seat region.

It is one of the objects of the present invention to provide an improved shoe support for the machine of the aforementioned type, in the use of which the operator can position the shoe upper on its last and maintain it in such position, while affording the operator ready access to the backpart region thereof.

It is a further one of the various objects of the present invention to provide a shoe upper conforming machine in which orientation of the shoe upper in relation to its last, and also positioning of the last in the shoe support, appropriately for a subsequent shoe upper conforming operation, takes place while the shoe support and operating instrumentalities of the machine are in a spaced-apart condition.

SUMMARY OF THE INVENTION

To illustrate the invention by way of example, a shoe support will be described in detail hereinafter for supporting a shoe, comprising an upper on a last, for a shoe upper conforming operation to be performed thereon. The shoe support comprises shoe holding means by which the forepart portion of the shoe can be held and which in turn comprises a toe pad and presser means engagable with the shoe bottom for cooperating with said toe pad. In addition, the shoe support comprises gripper means by which the upper of the shoe thus clamped can be drawn heightwise about the last in a direction away from the last bottom and also lengthwise in a direction away from the heel end of the shoe thus to tension the upper about its last. To this extent, the shoe support is generally similar to that described in U.S. patent application Ser. No. 3,138,810. In the illustrative shoe support, however, the gripper means comprises two grippers arranged at opposite sides of the shoe and the presser means comprises two presser members, one associated with each gripper and arranged to engage the shoe bottom adjacent the locality and which the gripper grips the shoe upper. The shoe support further comprises power means for urging each presser member against the shoe bottom while at the same time urging the gripper in an opposite direction and also urging the gripper in a direction extending lengthwise of the shoe. The presser member thus constitutes a reaction lever against which the gripper can pull, the position of the applied reaction force being in this case adjacent the shoe upper tensioning force, so that there is no significant tendency for the position of the last in the shoe support to be disturbed, and at the same time the presence of the presser members (a function of which is comparable with that of a holddown) does not interfere with the access by the operator to the heel end of the shoe upper.

More particularly in the illustrative shoe support each presser member is mounted for movement in a direction heightwise of the shoe upper on a support which is itself also mounted for movement in a direction heightwise of the shoe, and in addition the support supports the gripper associated with the presser member so that, upon heightwise movement of the support, the gripper is moved heightwise relative to the presser member. Furthermore, in the illustrative shoe support first power means is provided for effecting heightwise movement of the presser member to bring it into engagement with a shoe bottom and thereafter, through its mounting on the support, for effecting heightwise movement of the support and thus of the associated gripper. In addition, the gripper is mounted on said support for movement relative to the presser member in a direction lengthwise of the shoe, and second power means is provided for effecting such lengthwise movement of the gripper. It will thus be appreciated that a relatively compact shoe upper gripping and tensioning assembly is provided, which is located only in the forepart region of the shoe, while leaving the backpart of the shoe for ready access by the operator during the loading sequence.

It would be possible in accordance with the invention for the presser member to move vertically heightwise of the shoe, e.g. by sliding, in the illustrative shoe support the presser member is mounted for pivotal movement on its support, the arrangement being such that, after the presser member has been moved into engagement with the shoe bottom, continued operation of the first power means is effective through the pivot of the presser member, to cause the support to be moved heightwise as aforesaid, about a fulcrum defined by the point of engagement of the presser member with the shoe bottom. More particularly, the presser member is constituted by a lever having a shoe-engaging end portion and the first power means is operatively connected to said lever at the opposite side of its pivotal mounting from said shoe-engaging end portion. Thus, for moving the shoe engaging end portion into engagement with the shoe bottom, the first power means is effective to move the opposite end of the lever in a contrary direction. Of course, in other shoe supports in accordance with the invention, the operative connection of the first power means may be on the same side of the pivot as the shoe-engaging end portion of the lever, in which case the first power means is effective, in moving the shoe-engaging end portion into engagement with the shoe bottom, to apply its force in the same direction as such movement.

The illustrative shoe support is pneumatically controlled and the first power means comprises a piston-and-cylinder arrangement the cylinder of which is itself mounted on the support on which the presser member is pivotally mounted.

In the illustrative shoe support the support for the presser member is mounted for heightwise movement as aforesaid on a frame portion by means of a parallel linkage arrangement. In this way, the grippers are caused to move vertically of the shoe bottom when tensioning the upper. In order to accommodate shoes of different width, furthermore, said support is mounted for adjusting movement in a direction widthwise of the shoe, clamp means being provided for clamping said support in adjusted position. Such adjustment effectively varies the position of the support in relation to the parallel linkage arrangement, while maintaining the vertical movement facility thereof. Adjusting movement of the support also of course varies the widthwise position of the presser members.

The shoe-engaging end portion of each presser member of the illustrative shoe support is constituted by a generally U-shaped portion, arranged with the open end of the U facing towards the shoe bottom in order to accommodate the upstanding lasting margin of the shoe upper without disturbing its position. Furthermore, a generally flat portion is disposed at the free end of the shoe-engaging end portion, beyond the generally U-shaped portion thereof. This generally flat portion enables loose insoles to be accommodated over such flat portion so that the operator can first position an upper on its last and grip and tension it as aforesaid and then, prior to any shoe upper conforming operation, locate the loose insole on the last bottom; of course, in the case of an attached insole, the flat portion merely presses against the insole during the gripping and tensioning operation.

For moving the gripper lengthwise of the shoe as aforesaid, any suitable mounting may be used, and in the illustrative shoe support the gripper is supported by a housing mounted for pivotal movement, in a direction lengthwise of the shoe, on the support under the control of the second power means. The second power means comprises a piston-and-cylinder arrangement the cylinder of which is also mounted on the support for the presser member. More particularly, the gripper is carried on a slide mounted for adjusting movement relative to the housing in a direction heightwise of the shoe, clamp means being provided for clamping said slide in adjusted position. The position of the gripper can thus be adjusted heightwise of the shoe to cater for shoes of different depths. In addition, the slide provides a guideway which extends in a direction widthwise of the shoe and in which the gripper is mounted for sliding adjusting movement, the arrangement being such that the assembly is held by friction in its adjusted position. In this way also the grippers can be positioned widthwise of a shoe to accommodate shoes of different widths.

Still further, the gripper is also mounted for adjusting movement about an axis extending heightwise of the shoe whereby to accommodate to the style of shoe to be operated upon, clamp means again being provided for clamping the gripper in adjusted position. In this way, not only can different styles of shoe be accommodated, but also right and left shoes.

In the illustrative shoe support, the two supports for each of the shoe upper gripping and tensioning means are carried by a common frame portion which is itself supported, on a further frame portion, for adjusting movement in directions both heightwise and lengthwise of the shoe. In addition, said further frame portion is itself supported for adjusting movement in a direction lengthwise of the shoe bottom, clamp means being provided for clamping said portion in adjusted position. Furthermore, the toe pad is mounted on said further frame portion for adjusting movement in a direction heightwise of the shoe. It will thus be appreciated that there are many adjustments available for setting the position of each gripper and each presser member according to the style and size of shoe, and further for setting the toe pad lengthwise of the shoe according to shoe length.

In the illustrative shoe support, a heel support is also provided including a heel pin on which the heel end of the last of a shoe can be supported with the shoe bottom uppermost, and the gripper means and presser means are disposed above the level of the toe pad. By arranging for the shoe to be supported bottom uppermost, the operator has a clear overview of the shoe for positioning purposes and in addition can more readily feed the marginal portions of the upper into the grippers. In such an arrangement, furthermore, said further frame portion is mounted for adjusting movement as aforesaid on a frame portion forming part of the heel support, so that the toe pad is adjusted in relation to the heel pin in setting for the length of the shoe.

There is also hereinafter described in detail, to illustrate the invention by way of example, a shoe upper conforming machine in accordance with the invention, said machine comprising the illustrative shoe support on which, it will be appreciated, a shoe upper can be oriented correctly on its last, and the shoe as a whole be positioned in the shoe support for a shoe upper conforming operation, prior to presentation of the shoe to operating instrumentalities of the machine. In addition the illustrative machine comprises a holddown movable between an operative position, in which it is disposed in opposed relationship with the bottom of a shoe supported by the shoe support, and an out-of-the-way position together with means for moving the shoe support towards and away from the holddown. Thus, the holddown now serves no longer to assist in the gripping and tensioning of the shoe upper, but rather merely as a datum for determining the heightwise position to which the shoe bottom is moved, after it has been oriented and positioned, with the plane of the heel seat of the shoe coincident with a datum plane of the operating instrumentalities.

In the illustrative machine, the operating instrumentalities comprise a heel band and wiper means both mounted in a wiper head which is movable between an advanced, operative, position, which is determined by engagement of the heel band with the backpart of the shoe, and a retracted, out-of-the-way, position, the illustrative machine being adapted for use in carrying out the combined heel end assembling, backpart moulding and heel seat lasting operation. It should of course be noted that other machines in accordance with the invention may be intended for merely a backpart moulding operation, in which case wiper means need not be provided (although in some backpart moulding machines wiper means will be provided), or in a combined heel end assembling and backpart moulding machine. In any event, machines in accordance with the invention will usually be intended for carrying out a shoe upper conforming operation at the heel end as a first shoe upper conforming (lasting) operation.

The illustrative machine also comprises sequence control means whereby the holddown is first moved from its out-of-the-way position to its operative position, the shoe support is then moved towards the holddown to bring a shoe supported thereby to a heightwise position determined by engagement of the shoe bottom with the holddown, and thereafter the heel band is caused to clamp the heel end of the shoe upper on its last. (Whereas in the illustrative machine the wiper head is movable towards the shoe support, it will be appreciated that also within the scope of the invention is to be contemplated machines wherein the shoe support carries the oriented and located shoe into an operating locality of the machine at which the operating instrumentalities are located.)

Where a backpart moulding operation is to be carried out using the illustrative machine and in particular where the shoe upper includes a thermoplastic stiffener at the heel end, the illustrative machine comprises a heater station at which the heel end of the upper can be heated prior to being loaded with its last in the shoe support. Similarly, where a heel seat lasting operation is to be performed using the illustrative machine, the machine also comprises adhesive applying means whereby, prior to the operation of the wiper means, adhesive is applied to the shoe bottom (in this case constituted by an insole portion on the last bottom).

There now follows a detailed description, to be read with reference to the accompanying drawings, of the illustrative shoe support and forming part of the illustrative machine, which shoe support and machine have been selected for description merely by way of non-limiting example.

DETAILED DESCRIPTION OF THE PREFERRED EMBODIMENT

Figure 1:
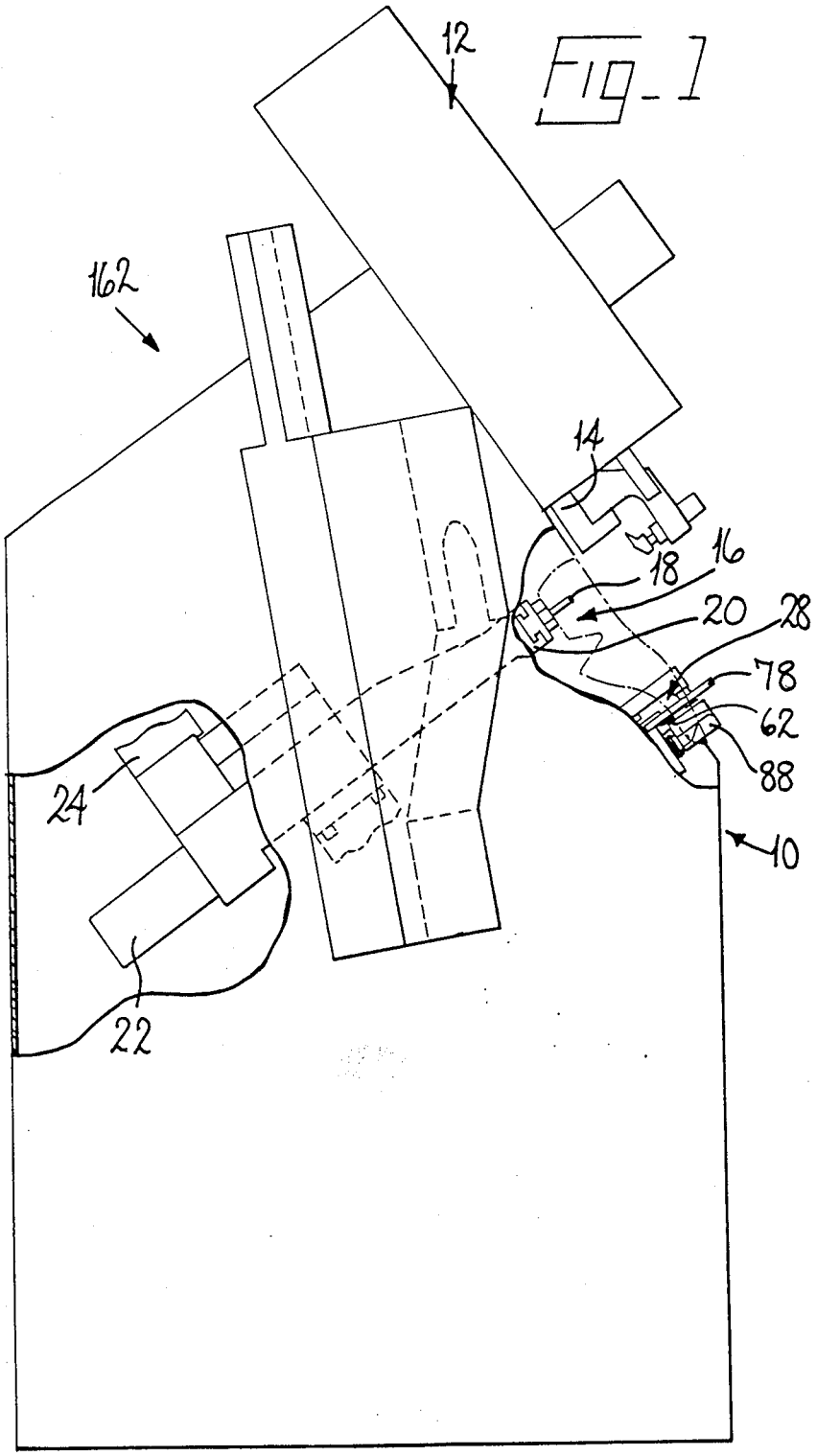
FIG. 1 is a side view indicating the lay-out of an operating station of the illustrative machine.
Figure 2:
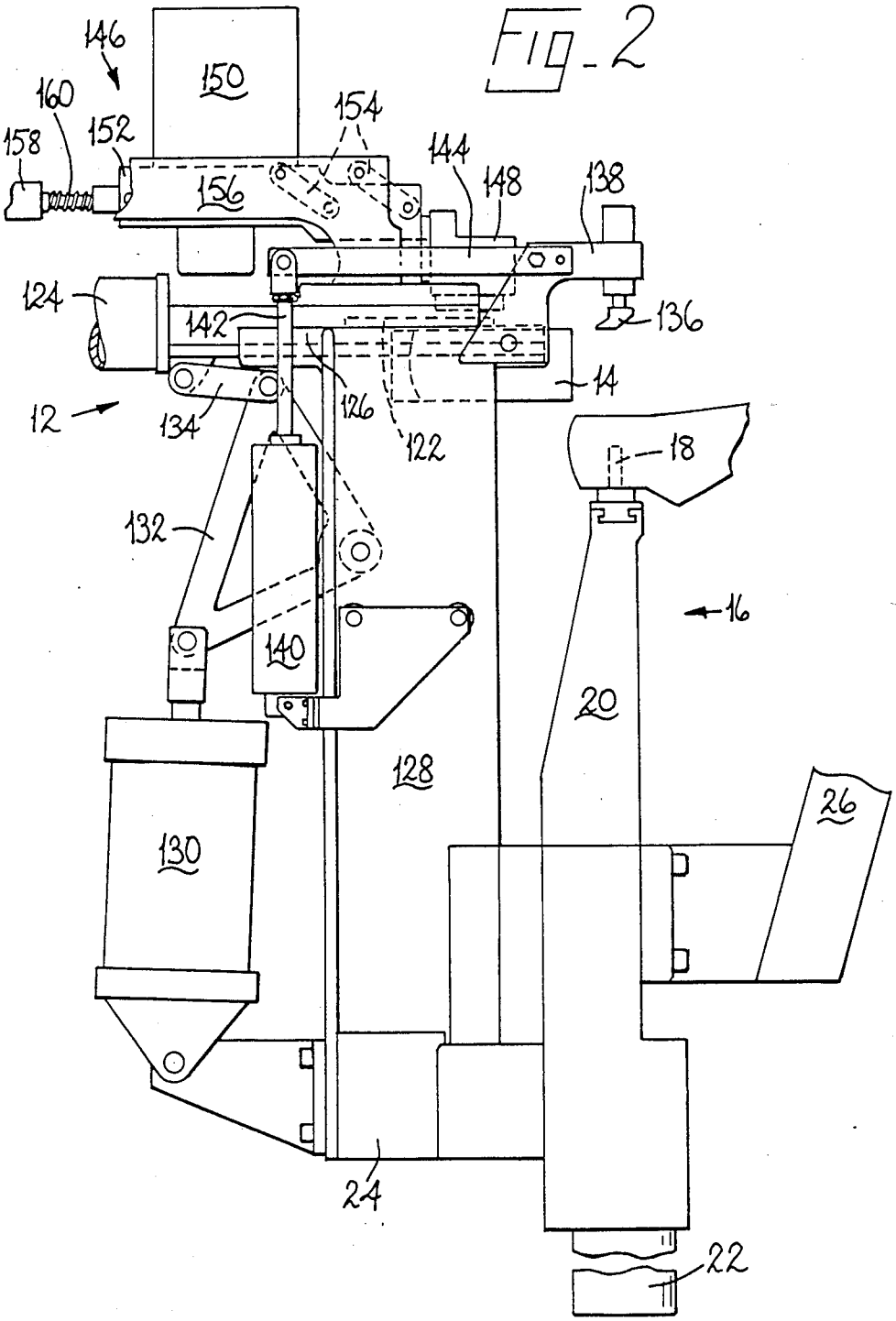
FIG. 2 is a side view showing details of parts of operating instrumentalities of the station shown in FIG. 1.

The illustrative machine is a machine for carrying out a combined operation of heel end assembling, backpart moulding and heel seat lasting of shoe uppers; such machines are utilised for enabling loose uppers to be positioned on a last on the bottom of which an insole has been located, and for securing the upper to the insole in the heel seat region thereof while at the same time effecting a moulding operation on the backpart of the upper. The machine thus comprises two operating stations (only one of which is indicated in the drawings) arranged side-by-side for alternate operation by the machine operator. The two stations are identical in construction. In practice one station is set up for operating on right shoes, the other on lefts. Only one station, viz. that for operating on right shoes, will now be described, said station comprising a shoe support generally designated 10 (being the illustrative shoe support) which is so arranged that a shoe is supported therein with the plane of its heel seat at an angle of 35° to the vertical, away from the operator. The station further comprises a wiper head generally designated 12, a heel band 14 and adhesive-applying means 146, together constituting operating instrumentalities of the station.

The illustrative shoe support 10 comprises a heel support generally designated 16, which comprises a so-called last pin 18 mounted on a column 20 which is movable in a direction heightwise of the heel seat of the shoe supported thereby, by means of a piston-and-cylinder arrangement 22 supported on a frame portion 24. Also mounted on the column 20 is a forwardly extending bracket 26 for supporting a toe support assembly generally designated 28, as will now be described.

Carried on the bracket 26 is a forwardly and rearwardly extending support slide 30 on which is supported for sliding movement a casting 32 having an upstanding column portion 34. The casting 32 is movable fore-and-aft by means of a threaded rod 36 captive in the support slide and threadedly engaging the casting, said rod being provided at its forward end with a hand wheel 38. A clamping lever 40 is provided for securing the casting in its adjusted position against the support slide 30.

At the upper end of the column portion 34 is a collar 42 having two pins 44 projecting therefrom diametrically opposite one another. Supported by the collar 42 is a height setting member 46 comprising a sleeve the side wall of which is provided with a stepped row of recesses 48 engagable with the pins 44. By selecting an appropriate recess 48, the height of the member 46 can thus be adjusted.

Carried within the column portion 34 is a support rod 50 having at its upper end a threaded portion on which a knurled nut 52 is secured, said nut resting on the top of the member 46. Thus, by rotating the nut 52 the support rod 50 can be raised or lowered within the column portion 34.

Mounted at the upper end of the support rod 50 is a block (not shown) in which is provided a guideway for a slide 54 on which a support housing 56 is carried. For moving the support housing fore-and-aft along the guideway, an adjustment bolt 58 is provided, captive in the housing and threaded into a portion of the block.

The upper end of the support rod 50 is tubular and receives therein a further rod 60 on which a toe pad 62 is carried. The rod 60 is threaded and carries a knurled adjusting nut 64 which rests on the upper end of the support rod 50. Thus, by rotating the nut 64, the height of the toe pad 62 in relation to the support housing 56 can be adjusted.

The support housing 56 is generally in the shape of an inverted U and supports, at each side thereof, a shoe upper gripping and tensioning assembly generally designated 66. These assemblies are mirror-opposites of one another, and consequently only one such assembly will now be described.

Figure 3:
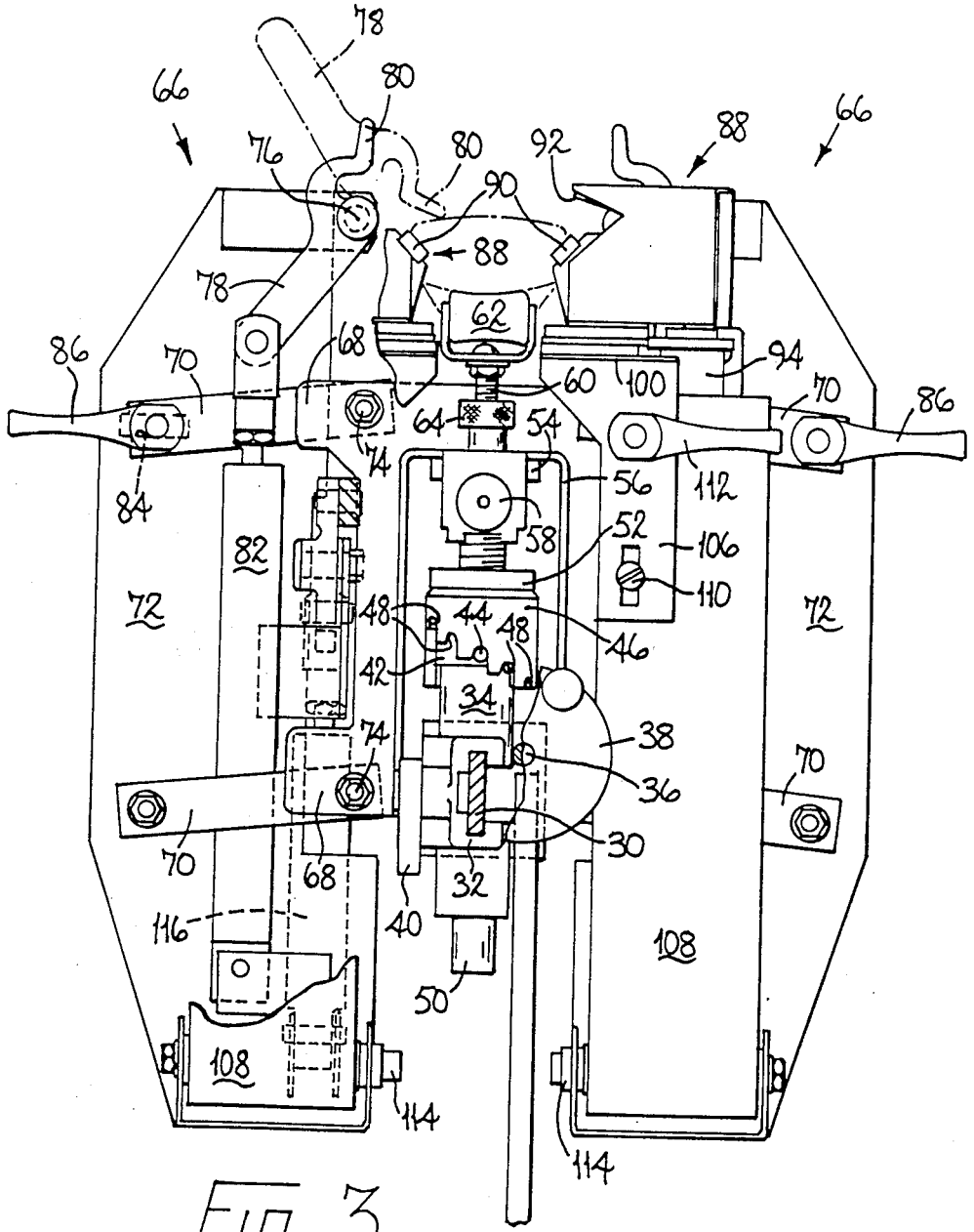
FIG. 3, is a front view showing details of the illustrative shoe support.
Figure 4:
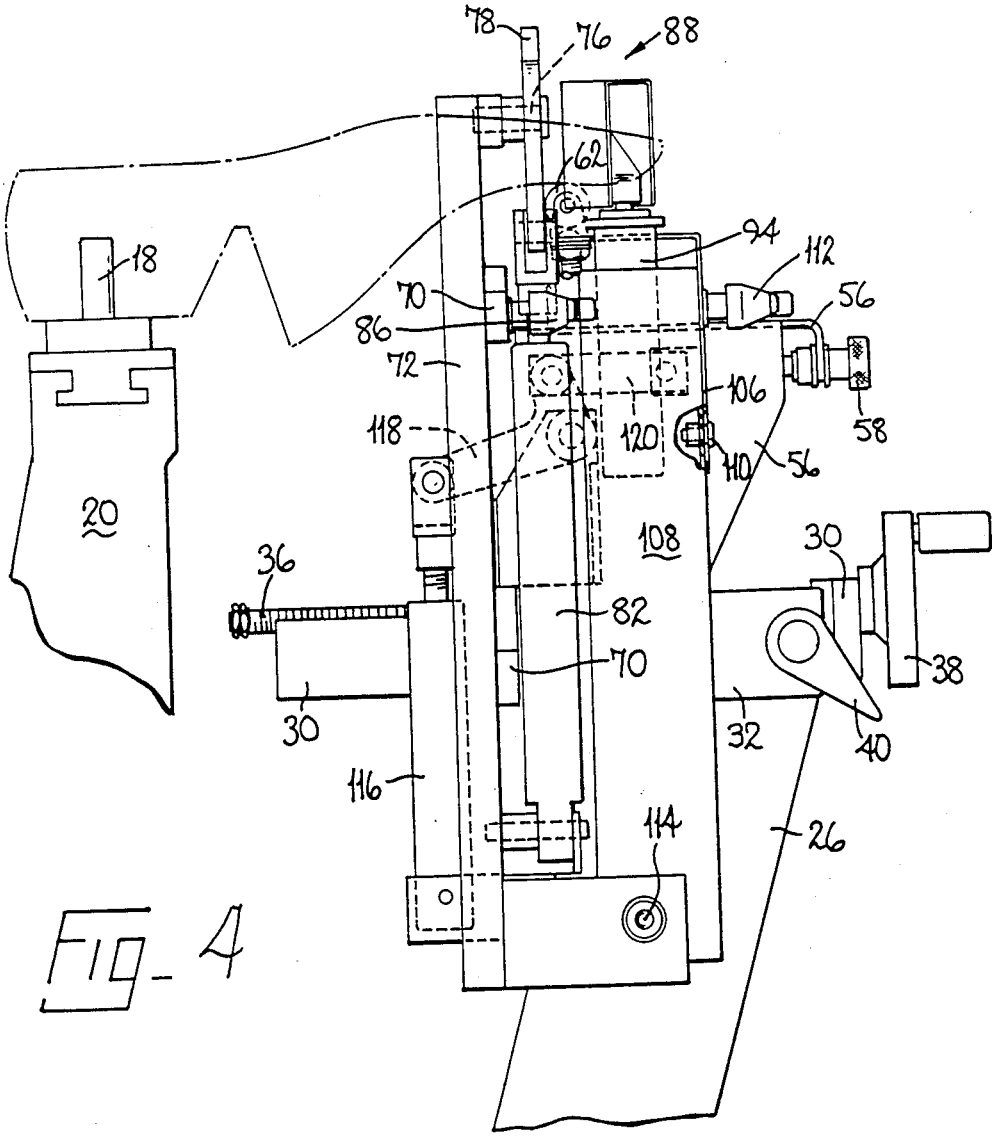
FIG. 4 is a side view of parts shown in FIG. 3.
Figure 5:
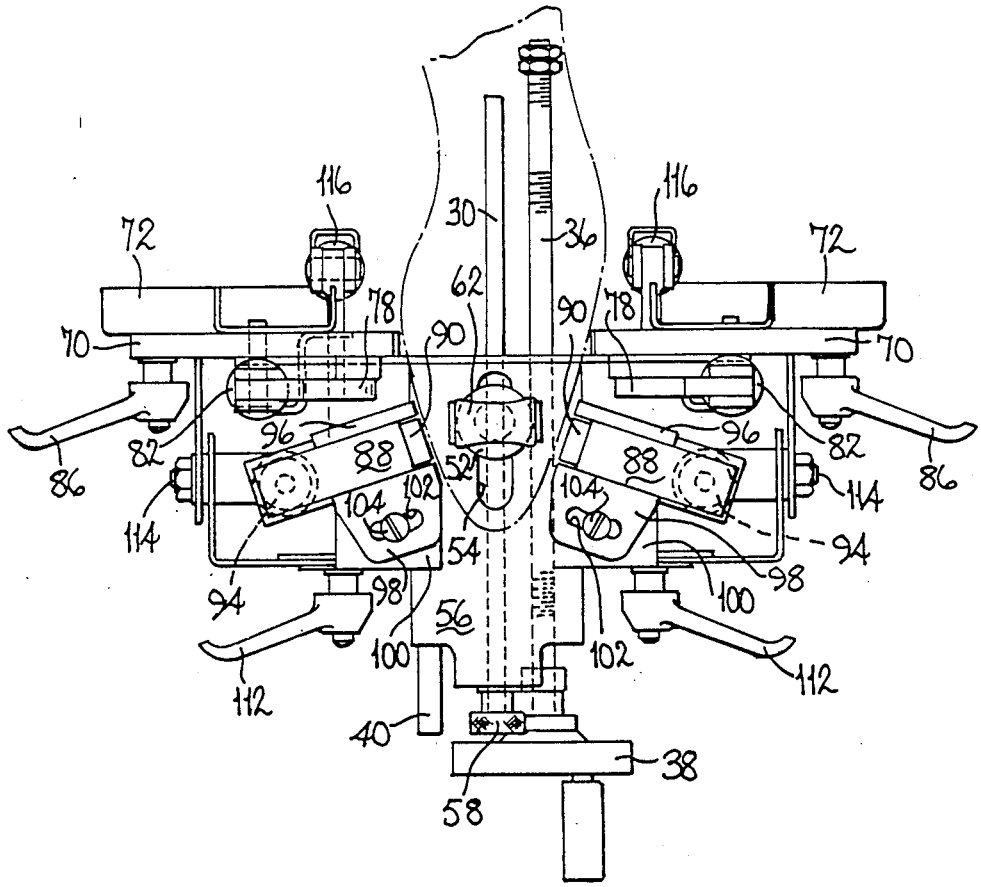
FIG. 5 is a plan view also showing details of the parts shown in FIG. 3.

Referring to the left hand side of FIG. 3 (in which part of the assembly has been broken away to show details not to be described), supported by pivots 74 on two spaced lugs 68 of the support housing 56 are two levers 70 on which in turn a support plate 72 is carried, the two levers 70 together with the plate 72 and the support housing 56 itself constituting a four-bar linkage arrangement by which the plate 72 can be moved up-and-down while remaining vertical; indeed, since the levers 70 extend substantially horizontally to their pivots 74, the movement of the plate, in moving up-and-down, will include only a small component of in-and-out movement.

The support plate 72 provides at its upper end a pivot 76 for a presser member, or so-called reaction lever, 78, the pivot and lever being so dimensioned and arranged that an inner end 80 of the lever will engage with the bottom of the shoe supported in the shoe support when said end 80 is pivoted downwardly theretowards. The reaction lever 78 is so shaped that its inner, shoe-engaging, end portion has a shape generally of an inverted U, whereby the lever can accommodate an upstanding lasting margin of the shoe upper. In addition, the free end of said lever, beyond the U-shaped portion, is flat and relatively narrow, for purposes to be referred to hereinafter. For pivoting the lever 78 about its pivot 76 a piston-and-cylinder arrangement 82 is provided mounted on the support plate 72.

For varying the position of the pivot 76, and thus of the reaction lever 78, in a direction widthwise of the shoe, the upper one of the levers 70 is connected to the support plate by a pin-and-slot connection 84, a clamp arrangement 86 being provided for clamping the lever and plate in adjusted position. When the clamp arrangement is released, the plate can pivot about the lower of the two pivots 74.

The shoe upper gripping and tensioning assembly 66 also comprises a gripper assembly generally designated 88. The gripper assembly comprises a fixed jaw 90 and a movable jaw 92 pivotal relative to the fixed jaw under the action of a piston-and-cylinder arrangement 94. The gripper assembly 88 is mounted for sliding movement, with a frictional fit, in a guideway 96 for movement towards and away from the shoe, said guideway being provided in a block 98 which is itself supported for pivotal movement on a support plate 100. The block 98 has a slot 102 formed therein and receiving a clamping screw 104 by which the block, and thus the gripper assembly 88, can be clamped in adjusted position on the plate 100. This plate is formed integral with a support 106 which is mounted for sliding heightwise adjusting movement on a support column 108. For guiding the support 106 a pin-and-slot guide is provided, and a clamp arrangement 112 secures the support 106 in heightwise adjusted position. The position of the gripper assembly 88 heightwise of the shoe bottom can thus be adjusted.

The support column 108 is supported at its lower end on a pivot 114 carried by the support plate 72, the axis of the pivot extending in a direction widthwise of the shoe whereby the gripper assembly 88 can move in a direction fore-and-aft of the shoe. For so moving the support column, and thus also the gripper assembly 88, a piston-and-cylinder arrangement 116 is provided, mounted on the support plate 72 and connected via a bell crank lever 118 and a link 120 to the support column 108.

The operating instrumentalities of the illustrative machine are generally similar to those of the machine described in U.S. patent application Ser. No. 3,138,810. Thus, at each station the wiper head 12 comprises a pair of wiper plates 122 mounted for movement, under the control of a cam plate (not shown), upon actuation of piston-and-cylinder arrangement 124. In addition, the wiper head 12 is movable bodily between an advanced, operative, position and a retracted, out-of-the-way, position, for which purpose the wiper head is supported in a slideway 126 forming part of a frame portion 128 of the machine. Also supported on said frame portion is a piston-and-cylinder arrangement 130 which is connected, via a triangular lever 132 and a link 134, to the wiper head 12, actuation of the piston-and-cylinder arrangement 130 effecting movement of the wiper head between its two positions. The heel band 14 is also mounted for movement with the wiper head, the arrangement being such that, after the band has engaged the heel end of the shoe, thereby limiting the forward movement of the wiper head and determining its operative position, the band is caused to clamp around the heel end portion of the shoe. This is described in detail in the aforementioned U.S. specification.

The illustrative machine also comprises at each station a holddown 136 which is mounted, for heightwise adjusting movement, in a bracket 138 extending widthwise of the machine, said bracket being mounted at the upper end of the frame portion 128 for pivotal movement under the control of a piston-and-cylinder arrangement 140, a piston rod 142 of which is connected via a link 144 to the bracket 138. Pivoting the holddown to an out-of-the-way position facilitates the loading of a shoe on the last pin 18. For limiting the downward movement of the holddown into its operative position, a shoulder on the bracket 138 engages with a corresponding abutment shoulder on the frame portion 128. The holddown 136 is effective to set the height to which a shoe carried on the shoe support 10 is raised under the action of piston-and-cylinder arrangement 22, and thus sets the position of the heel seat in relation to the wiper plates 122.

The adhesive-applying means 146 of each station of the illustrative machine comprises a nozzle plate 148 in the under-surface of which is a generally U-shaped array of outlets for adhesive, said outlets being connected through the nozzle plate 148 to a melt chamber 150, the nozzle plate and melt chamber being themselves supported on a carrier plate 152. The carrier plate 152 is supported by two pairs of parallel links 154 in a casting 156 supported by the wiper head 12. The casting, and thus the nozzle plate 148, is movable downwardly and rearwardly upon actuation of a piston-and-cylinder arrangement 158, a spring 160 being disposed on the piston rod of said arrangement for urging the casting, and thus the nozzle plate, to an out-of-the-way position.

In the operation of the illustrative machine, when a shoe has been loaded onto the last pin 18, with its bottom facing upwardly, the upstanding lasting margin in the region of the forepart of the shoe is located between the open gripper jaws 90,92 and a cycle of operation of the machine is then initiated by the operator tripping a foot treadle (not shown). Thereupon, the.grippers are closed, by actuation of the piston-and-cylinder arrangement 94, and, upon actuation of the piston-and-cylinder arrangements 82 under relatively low pressure, the reaction levers 78 are caused to pivot about their pivots 76 to bring the shoe-engaging end portions thereof into engagement with the shoe bottom and to apply an initial tension to the upper by the gripper assemblies 88. At this stage, release of the treadle will return the various instrumentalities to their rest position. Upon a further tripping of the treadle, relatively high pressure is applied to the arrangements 82 whereby the support plates 72 to be raised under such increased pressure, about a fulcrum determined by the point of engagement of the shoe-engaging end portions 80 with the shoe bottom, thus to lift the gripper assemblies 88 and thereby tensioning the shoe upper heightwise about the last. Thereafter, in sequence, piston-and-cylinder arrangements 116 are actuated to cause the support columns 108 to be pivoted about the pivots 114 to move the gripper assemblies 88 in a direction away from the heel end of the shoe, thus to cause the shoe upper to be tensioned lengthwise of the last, in particular tensioning the backpart of the upper about the heel end portion of the last.

At this stage the holddown 136 is then caused to be moved downwardly, by actuation of piston-and-cylinder arrangement 140, and thereafter the shoe support 10 is moved bodily upwardly, under the action of piston-and-cylinder arrangement 22, to a height determined by the engagement of the heel seat portion of the shoe bottom with the holddown 136. At this stage the supply of air under pressure to the arrangement 22 is at low pressure, so that the shoe moves to the datum position as set by the holddown without disturbing the position of the latter. Thereafter, actuation of piston-and-cylinder arrangement 130 is effected to cause the wiper head 12 to be moved to its advanced, operative, position, as determined by engagement of the heel band 14 with the backseam region of the shoe, and in this position piston-and-cylinder arrangement 158 is actuated to cause the nozzle plate to be moved rearwardly and downwardly into engagement with the heel seat region of an insole placed on the shoe bottom, adhesive then being pumped from the melt chamber 150 through the outlets in the nozzle plate 148 for application of adhesive to the shoe bottom. Thereafter, following retraction of the nozzle plate, piston-and-cylinder arrangement 124 is actuated to cause the wiper plates 122 to be advanced and moved inwardly, thus to wipe upstanding lasting marginal portions of the shoe upper over and press them against corresponding marginal portions of the insole in the heel seat region. At the same time, as described in detail in the aforementioned U.S. specification, the sides of the heel band are pressed against side portions of the shoe thus to conform the backpart region of the shoe upper to the shape of the last. When the wiper plates 122 are thus advanced, the holddown 136 is then retracted and a relatively high pressure is applied to the piston-and-cylinder arrangement 22 to apply bedding pressure to the lasting margin. Also at this time the gripper assemblies 88 release the upper and the reaction levers 78 are returned to their initial position.

It will be appreciated that, in addition to a backpart moulding and heel seat lasting operation being performed upon the shoe upper, the shoe upper is also assembled on its last in the operation of the machine, which, it will be appreciated, is intended for carrying out a heel seat lasting operation as a first lasting operation. If desired, the insole may be secured to the last bottom in any desired manner prior to the last being place upon the last pin 18. Alternatively, however, if desired the insole may be placed loose on the last bottom after the last has been inserted in the machine, and to this end the shoe-engaging end portion of each reaction lever 78 is provided with the narrow flattened ends, above which the insole can lie during the gripping and tensioning of the shoe upper. Thus, in using this machine, it is not necessary for the insole to be conventionally attached to the last bottom prior to the operation being carried out.

The machine may be used with shoe upper components of various kinds, but in particular is intended for use with shoe uppers having a heel end stiffener of thermoplastic material, and to this end heater means generally designated 162 is provided for pre-heating the heel end portion of each shoe upper prior to its being placed on its last in the machine, such pre-heating serving to activate the thermoplastic material and render it thermoformable for the backpart moulding operation. The heater means may be of any conventional kind.

What is claimed is:

1. A shoe support for supporting a shoe, comprising an upper on a last, for a shoe upper conforming operation to be performed thereon, said support comprising:

shoe holding means by which the forepart portion of the shoe can be held, said shoe holding means comprising a toe pad and presser means engagable with the shoe bottom for co-operating with said toe pad, and gripper means by which the upper of the shoe thus clamped can be drawn heightwise about the last in a direction away from the last bottom and also lengthwise in a direction away from the heel end of the shoe thus to tension the upper about its last, wherein the gripper means comprises two grippers arranged at opposite sides of the shoe, and the presser means comprises two presser members, one associated with each gripper, and wherein each presser member is mounted for movement in a direction heightwise of the shoe on a support which is itself also mounted for movement in a direction heightwise of the shoe, said support also supporting the gripper associated with the presser member for movement relative to the latter in a direction lengthwise of the shoe, the shoe support also comprising first power means for effecting heightwise movement of the presser member to bring it into engagement with a shoe bottom and thereafter, through its mounting on the support, for effecting heightwise movement of said support, and thus of the associated gripper, and second power means for effecting movement of the gripper lengthwise of the shoe.

2. A shoe support according to claim 1 wherein the first power means comprises a piston-and-cylinder arrangement the cylinder of which is mounted on the support on which the presser member is pivotally mounted.

3. A shoe support according to claim 2 wherein the second power means comprises a piston-and-cylinder arrangement the cylinder of which is mounted on the support for the presser member.

4. A shoe support according to claim 1 wherein the support for the presser member is mounted for heightwise movement as aforesaid on a frame portion by means of a four-bar linkage arrangement.

5. A shoe support according to claim 4 wherein the support for the presser member is mounted for adjusting movement in a direction widthwise of the shoe, clamp means being provided for clamping said support in adjusted position.

6. A shoe support according to claim 1 wherein the presser member is mounted for pivotal movement on its support and wherein, after the member has been moved into engagement with a shoe bottom, continued operation of the first power means is effective, through the pivot of the member, to cause the support to be moved heightwise as aforesaid, about a fulcrum defined by the point of engagement of the presser member with the shoe bottom.

7. A shoe support according to claim 6 wherein the presser member is constituted by a lever having a shoe-engaging end portion and also wherein the first power means is operatively connected to said lever at the opposite side of its pivotal mounting from said shoe-engaging end portion.

8. A shoe support according to claim 7 wherein the first power means comprises a piston-and-cylinder arrangement the cylinder of which is mounted on the support on which the presser member is pivotally mounted.

9. A shoe support according to claim 7 wherein the support for the presser member is mounted for heightwise movement as aforesaid on a frame portion by means of a four-bar linkage arrangement.

10. A shoe support according to claim 9 wherein the support for the presser member is mounted for adjusting movement in a direction widthwise of the shoe, clamp means being provided for clamping said support in adjusted position.

11. A shoe support according to claim 10 wherein the second power means comprises a piston-and-cylinder arrangement the cylinder of which is mounted on the support for the presser member

12. A shoe support according to claim 1 wherein each said presser member comprises a shoe-engaging end portion constituted by a generally U-shaped portion.

13. A shoe support according to claim 12 wherein a generally flat portion is desposed at the free end of the show-engaging end portion beyond the generally U-shaped portion thereof.

14. A shoe support according to claim 1 wherein each gripper is supported by a housing amounted for pivotal movement, in a direction lengthwise of the shoe, on the support under the control of the second power means.

15. A support according to claim 14 wherein each gripper is carried on a slide mounted for adjusting movement relative to the housing in a direction heightwise of the shoe, clamp means being provided for clamping said slide in adjusted position.

16. A shoe support according to claim 15 wherein the slide provides a guideway which extends in a direction widthwise of the shoe and in which the gripper is mounted for sliding adjusting movement, the arrangement being such that the assembly is held by friction in its adjusted position.

17. A shoe support according to claim 16 wherein the gripper is also mounted for adjusting movement about an axis extending heightwise of the shoe whereby to accommodate to the style of shoe to be operated upon, clamp means being provided for clamping the gripper in adjusted position.

18. A shoe support according to claim 1 wherein the two supports for the presser members are carried by a common frame portion which is itself supported, on a further frame portion, for adjusting movement in directions both heightwise and lengthwise of the shoe.

19. A shoe support according to claim 18 wherein the further frame portion is supported for adjusting movement in a direction lengthwise of the shoe bottom, clamp means being provided for clamping said portion in adjusted position.

20. A shoe support according to claim 19 wherein the toe pad is mounted on said further frame portion for adjusting movement in a direction heightwise of the shoe.

21. A shoe support according to claim 19 wherein a heel support is provided including a heel pin on which the heel end of the last of a shoe can be supported with the shoe bottom uppermost, and the gripper means and presser means are disposed above the level of the toe pad, and further wherein said further frame portion is mounted for adjusting movement as aforesaid on a frame portion forming part of the heel support.

22. A shoe support according to claim 1 wherein a heel support is provided including a heel pin on which the heel end of the last of a shoe can be supported with the shoe bottom uppermost, and the gripper means and presser means are disposed above the level of the toe pad.

23. A shoe upper conforming machine comprising a shoe support according to claim.1, a holddown movable between an operative position, in which it is disposed in opposed relationship with the bottom of a shoe supported by the shoe support, and an out-of-the-way position, means for moving the shoe support towards and away from the holddown, a heel band, and sequence control means whereby the holddown is first moved from its out-of-the-way position to its operative position, the shoe support is then moved towards the holddown to bring a shoe supported thereby to a heightwise position determined by engagement of the shoe bottom with the holddown, and thereafter the heel band is caused to clamp the heel end of the shoe upper on its last.

24. A machine according to claim 23 wherein a heater station is provided at which the heel end of the upper can be heated prior to being loaded with its last in the shoe support.

25. A machine according to claim 23 wherein wiper means is also provided whereby, after the heel end of a shoe upper has been clamped by the heel band as aforesaid, the lasting margin thereof is wiped over and pressed against the shoe bottom.

26. A machine according to claim 25 wherein adhesive-applying means is provided whereby, prior to the operation of the wiper means, adhesive is applied to the shoe bottom (constituted by an insole portion on the last bottom).

* * * * *